United States Patent [19]

Woodward et al.

[11] Patent Number: 4,821,841

[45] Date of Patent: Apr. 18, 1989

[54] SOUND ABSORBING STRUCTURES

[76] Inventors: Bruce Woodward; Daniel W. Martin; William Miller, all of 912 Baxter Ave., Louisville, Ky. 40204

[21] Appl. No.: 62,846

[22] Filed: Jun. 16, 1987

[51] Int. Cl.[4] ..... E04B 1/82

[52] U.S. Cl. ..... 181/286; 181/288; 181/290

[58] Field of Search ..... 181/285–288, 181/290, 295, 292, 293

[56] References Cited

U.S. PATENT DOCUMENTS

| | | | |
|---|---|---|---|
| 1,825,770 | 10/1931 | Barnett | 181/293 |
| 2,007,130 | 7/1935 | Munroe et al. | 181/285 |
| 2,335,728 | 11/1943 | Benecke | 181/285 |
| 2,887,173 | 5/1959 | Boschi | 181/292 X |
| 2,913,075 | 11/1959 | Zittle | 181/290 X |
| 2,933,146 | 4/1960 | Zaldastani et al. | 181/285 X |
| 2,989,136 | 6/1961 | Wohlberg | 181/224 |
| 4,071,989 | 2/1978 | Warren | 181/285 X |
| 4,244,439 | 1/1981 | Wested | 181/288 X |
| 4,257,998 | 3/1981 | Diependrock Jr. et al. | 181/286 X |
| 4,279,325 | 7/1981 | Challis | 181/292 X |
| 4,621,709 | 11/1986 | Naslund | 181/288 X |

*Primary Examiner*—B. R. Fuller

*Attorney, Agent, or Firm*—Charles G. Lamb

[57] ABSTRACT

The instant invention involves a sound absorbing structure which is formed from at least two adjacent panels which are assembled so as to provide a narrow slot of between about 1/16 and ¾ inch between the panels. The slot opens into a resonance cavity formed by the panels, their support strips, and a bottom member. The resulting sound absorbing structure provides substantial sound absorption at frequencies of less than about 1000 Hz.

18 Claims, 2 Drawing Sheets

FIG. 1
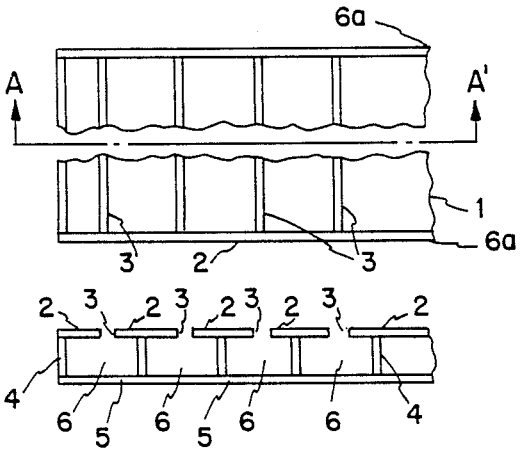
FIG. 2
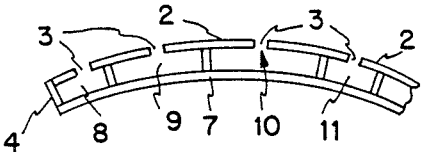
FIG. 4
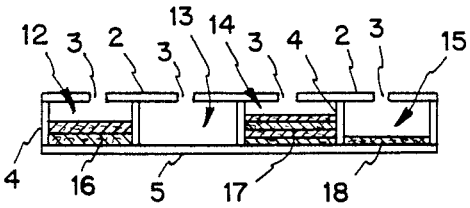
FIG. 6
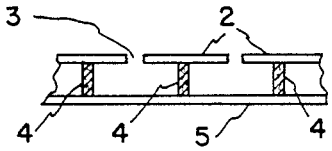
FIG. 9
FIG. 3
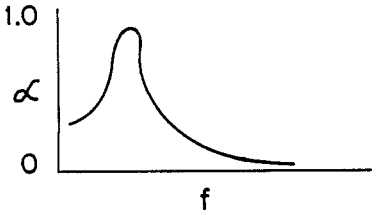
FIG. 5
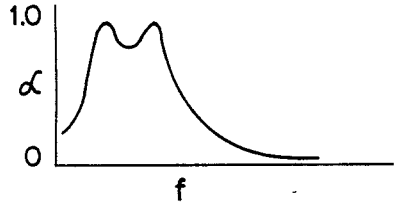
FIG. 7
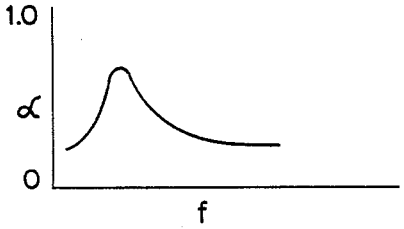
FIG. 8
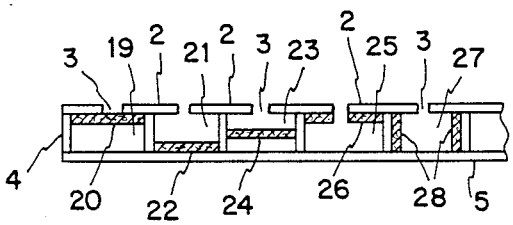

SOUND ABSORBING STRUCTURES

BACKGROUND OF INVENTION

1. Field of Invention

This invention relates to sound absorbing structures. More particularly, this invention relates to structures which may be added to walls or ceilings and which are designed to absorb sound particularly at frequencies of less than about 1000 Hz.

2. Prior Art

The acoustics of a room or other enclosure depend primarily upon the acoustical properties of its walls, floor and ceiling. Depending upon which material or combination of materials is chosen, the sound absorption of a particular room may vary widely. Wooden paneling, for example, when backed by an air space which may be present when paneling is installed over furring strips, is a moderate absorber of low frequency sound but provides little absorption at frequencies above about 1000 Hz. Draperies and curtains moderately absorb medium and higher frequency sounds but absorb little of lower frequency sounds, particularly when they are installed or maintained in close proximity to a rigid wall. Carpeting, in contrast, is relatively effective as an absorber of high frequency sounds but provides little absorption at the lower end of the audible range of acoustic frequencies.

Concrete, masonry, masonry blocks and gypsum boards are frequently employed in modern construction. However, most of these materials are extremely hard and absorb little, if any, sound. Sound damping may be obtained by employing carpeting on floors and by installing porous materials such as acoustical ceiling tiles. However, covering ceilings and floors does not adequately solve all acoustical problems. In fact, even in the presence of carpeting and acoustical ceiling tiles, many sounds will produce ringing or flutter echoes which reflect back and forth between the surfaces of parallel, reflective walls formed of masonry or plaster.

Masonry and other rigid sound absorbing structural elements have been disclosed in patents such as U.S. Pat. No. 2,933,146, in which each masonry block cavity resonates in a Helmholtz manner (see pp. 42–44, *Sensations of Tone,* Herman Helmholtz) with a slot in the cavity wall. U.S. Pat. No. 4,071,989 also discloses a block-type acoustical resonator but these patents do not provide for continuous panels enclosing a single resonance cavity as disclosed herein. U.S. Pat. No. 2,007,130 describes a sound absorption unit which is formed from terra cotta. The cavity behind longitudinal slits disclosed in this patent is completely filled with a sound absorbing material which eliminates Helmholtz resonance absorption. These units are load bearing elements which are too heavy and too costly for use in normal decorative applications.

The use of curved wall units is also known. See, for example, U.S. Pat. No. 2,913,075. Again, however, the unit described in the patent does not provide the combination of acoustical properties that the applicants' invention does.

U.S. Pat. No. 2,335,728 discloses a floor unit in which the cavity behind the face plate may be open.

U.S. Pat. No. 2,989,136 discloses a sound attenuation mechanism primarily for use with aviation engines. The individual panels, as demonstrated in FIG. 6, require that the opening at 112 be relatively similar in size to the length of the covering bodies 116.

Accordingly, none of these references or patents disclose the use of elongated, thin-walled panels of the type disclosed herein.

Thus it is an object of this invention to provide a sound absorbing wall structure which has enhanced, low frequency, sound absorption.

It is another object of this invention to provide sound absorptive wall and ceiling structures which may be applied to standard structural room walls and ceilings for decorative effect.

It is a further object of this invention to provide panel mounting means which will allow panels to better absorb sound mechanically at the mechanical resonance frequencies of the mounted panels themselves.

Another object of this invention is to provide a system which will absorb sound across much of the audible sound frequency range.

Yet another object of this invention is to provide a sound absorptive wall structure which can easily be installed over existing walls by installers having limited skills.

These and other objectives are obtained by constructing the apparatus of the instant invention.

SUMMARY OF INVENTION

In the present invention, the natural acoustical properties of air space-backed panels are supplemented by forming acoustical structures having controlled width, narrow, slots formed between elongated, rectangular panels. These slots open into acoustical cavities which, together with the slots, act as Helmholtz resonators. The slots themselves are narrow enough to be virtually unnoticeable by a casual observer and thus do not interfere with the decorative appearances of the wall surface.

The acoustical resonance cavities are created, according to the instant invention, by securing the panels over elongated support strips. Preferably, the acoustical cavity behind the panels and between the support strips, is enclosed by end closures which may be formed either from end caps or by butting the panels against the floor or ceiling to form an enclosed sealed cavity open only through the elongated slot. The end caps should be of substantially the same height as the ends of the support strips so as to form a cavity of substantially uniform height. The "bottom" of the sealed cavity which is opposite the elongated slot may be either a wall section of the continuous wall to which the support strips are attached, or may be formed by a separate, substantially continuous backing means. As used herein the term "wall section" includes ceiling, wall or floor sections.

The acoustical effect of applying the structure of the instant invention to a wall section is to increase the sound absorption of the wall section to nearly 100 percent at the Helmholtz resonance frequency, and to provide substantially increased sound absorption at neighboring frequencies as well. Also, by forming the structures described herein so that resonance cavities of different dimensions are constructed, it is possible to produce high absorption structures which absorb sound over a broad range of frequencies.

The length of the panels employed to form the resonance cavities is at least three and preferably eighteen or more times the width of each panel unit. The panels are generally rectangular in shape and are preferably no thicker than necessary to maintain structural integrity.

The distance between adjacent slots is relatively small, on the order of 4 to about 12 inches. The slots themselves should have a width in the range of about 1/16 to about ¾ inch. The panels are preferably attached to the support strips such that a constant width slot is provided, but the slot's width may vary as long as the overall average distance between adjacent panels is maintained in the 1/16 to ¾ inch range.

In order to increase the efficient absorption frequency range, the present invention also permits a fibrous, sound absorbing, material to be installed within the acoustical cavity. Sound incident upon the slotted surface exterior passes through the narrow slots, by diffraction around the corners, into the acoustical cavities where the fibrous material absorbs much of the sound before it can exit the slot. The sound absorbing material may be attached to the support strips, to the bottom, to the inner back sides of the panels or it may be suspended within the cavity itself.

In order to insure that the panels retain or enhance their normal sound absorption at their mechanical resonance frequencies, the invention in addition provides means for mounting the panels with less than conventional contact surface between the panel and its support strip. For example, the support strip may include a narrow longitudinally raised section, or ridge, for attaching the panel to the strip, leaving the panel spaced slightly apart from the remainder of the support strip width so that the panel may vibrate more freely when driven by sound waves.

These and other features and objects of the present invention will be understood more fully from the following detailed description which should be read in the light of accompanying drawings.

BRIEF DESCRIPTION OF THE DRAWING

FIG. 1 is a face view of a sound absorbing structure employing the instant invention.

FIG. 2 is a cut-away side view of the FIG. 1 structure taken along the line A, A'.

FIG. 3 is a representational graph showing the frequency versus absorption characteristics of a typical absorber of the type illustrated in FIGS. 1 and 2.

FIG. 4 is a cut-away side view of a curved wall embodying the instant invention in which there are two different cavity sizes so that certain of the resonators are tuned to one frequency, and others are tuned to a different frequency resulting in broader absorption/frequency characteristics as shown in FIG. 5.

FIG. 6 is a cut-away side view of an alternate means for tuning the cavities to produce different resonance frequencies.

FIG. 7 is a representational graph illustrating the absorptive/frequency characteristics of the FIG. 8 absorption structure.

FIG. 8 is a cut-away side view of the instant invention in which fibrous sound absorbing materials are installed within the resonators at several different locations to provide a wider frequency range of sound absorption as shown in FIG. 7.

FIG. 9 is a cut-away side view showing an alternative means of installing the fibrous sound absorbing material which conceals the material from outside exposure and protects it from damage.

DETAILED DESCRIPTION OF INVENTION

Figure 10:
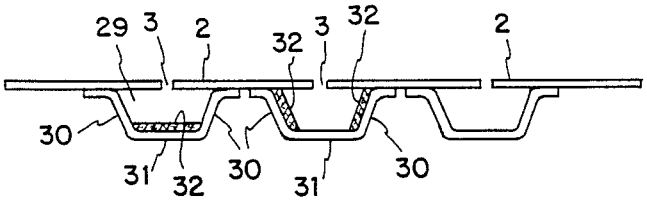
FIG. 10 is a cut-away side view of an embodiment of the instant invention in which the bottom and the support strips are independent of the wall or ceiling to which the structure is to be attached.

A sound absorptive wall panel structure (1) is shown in FIGS. 1 and 2. FIG. 1 shows the exterior face of the structure consisting of elongated rectangular panels (2) placed adjacent to each other so as to form controlled width, narrow slots (3) between them.

FIG. 2 shows the same structure taken in cross-section along the line A, A' of FIG. 1. This side view of the instant invention shows the panels (2) which have been attached to support strips (4) so as to form the controlled width, narrow slots (3). Providing a bottom for the acoustical cavities (6) formed thereby is a bottom member (5). Also shown in FIG. 1 are end closures (6a) which are provided on each end of the panel structure so as to enclose the acoustical cavity (6) providing an exit/entry only through the slot (3). When the panels (2) extend from floor to ceiling the end closures may not be required.

The air in the slots between each panel and the next panel provides acoustical inertances. Behind each slot is the acoustical cavity (6) which serves as an acoustical capacitance. The combination of the mass of air in the slot (3) and the "springyness" of the air in the cavity (6), as it is alternatively compressed and expanded by the flow of air into and out of the cavity when the sound wave is incident upon the exterior surface, functions as a Helmholtz resonator.

As shown in FIG. 3 the structure of the instant invention, particularly as exemplified in FIGS. 1 and 2, provides a large percentage of sound absorption $\alpha$ in the low end of the frequency range. As pointed out above, and as shown in other figures such as FIGS. 4 and 5, the acoustical resonance frequency of the structure of the instant invention may be changed or broadened by altering the relative sizes of the resonance cavities using the teachings of this invention.

One of the advantages of the present invention is that it is readily adaptable to walls having shapes which are not flat. For example, as shown in FIG. 4, cavities may be prepared wherein the bottom member (7) is rounded. The rounding may be provided either by the wall itself wherein the wall acts as the bottom member for the cavities or by a preformed structural bottom member which either may be attached to a structural wall or can stand alone. As further shown in FIG. 4, the cavities (8), (9), (10) and (11) may be formed having different widths to provide different peak absorption frequencies. In FIG. 4, cavities (8) and (11) resonate with their slots and have maximum absorption in the same frequency range, a range which is different from the frequency of maximum absorption for larger cavities (9) and (10). As a result, as shown in FIG. 5, two different resonance absorption peaks are provided. The total effect is to extend the range of frequencies over which resonance and associated sound absorption are provided. In constructing these variable cavity size structures, the panels (2) may be of the same width with different spacings between support strips (4), or the panels may be of different size to accommodate the varying capacitances of the sound cavities. In addition, as pointed out above, the size and arrangement of the slots (3) may also be altered in order to extend the frequency range over which the resonance cavities operate.

In FIG. 6 another structure contemplated by the instant invention is disclosed wherein means are provided for tuning the various cavities to absorb sound at varying frequencies. As illustrated in FIG. 6, a construction providing four different absorption frequencies is shown. In order to produce cavities of varying dimensions, bottom spacers (16), (17) and (18) are inserted into the cavities to form cavities (12), (14) and (15) which each having volumes which are different from each other and different from unobstructed cavity (13) which does not contain a bottom spacer. The bottom spacer generally extends the length of the resonance cavity and preferably terminates in contact with the end caps. As the volume of the cavity is reduced the resonance frequency increases so that the FIG. 6 device would produce an approximate absorption versus frequency similar to that shown in FIG. 5, except that there would be greater extension of the upper frequency absorption range.

FIG. 8 is similar to FIG. 2 except that strips of fibrous sound absorbing material have been inserted within the resonance cavity, preferably along the entire length of each cavity in the locations shown. Examples of such fibrous materials include carpeting, fiberglass, wool and other fiber-like material which are formed into discrete shapes and which may be attached by any convenient means to any location within the cavity including the bottom member, the support strips or the backs of the panels themselves. Thus, in cavity (19) the fibrous material (20) actually covers the slot and is attached to the back of the panels. In cavity (21) the fibrous material (22) is attached to the bottom member of the cavity. In cavity (23) the fibrous material (24) is suspended in the middle of the cavity. In cavity (25) the fibrous material (26) is attached to a panel on either side of the slot while in cavity (27) the fibrous material (28) is attached to either side of the support strip. The presence of the fibrous material tends to reduce somewhat the peak absorption frequency at lower frequencies but greatly increases the amount of absorption at medium and high audible frequencies.

The choice among the various possible sites of locating the fibrous material as shown in FIG. 8 depends upon a number of factors. The fibrous material located at (20) requires the least amount of fibrous material for the same about of absorption. The material located at (22) is more convenient if it is to be added during field installation. The fibrous material at (24) provides greater absorption at lower frequencies than does the material at (22) but has the disadvantage that a separate support means for the fibrous material may be necessary in order to maintain its location within the cavity. In each of the three cases (20), (22) and (24) damage of the fibrous materials through the insertion of screw drivers or other types of instruments is still possible. By installing the fibrous material as shown at (26) or at (28) the hazards of vandalism are reduced.

By locating the fibrous sound absorbing material at (20) or (26) the material also adds a small amount of mechanical damping to the vibration of the panels through contact with the panels. This reduces the sharpness of the panel's mechanical resonances and the resulting sound absorption by the panels themselves, but it also reduces the possibility that disturbing rattles may occur in the structure.

FIG. 9 shows an alternative means of installing the fibrous sound absorption material. In this instance, the fibrous sound absorbing material serves as the support strip, but is sufficiently impermeable to sound to avoid acoustical coupling between adjacent cavities. At the same time the surface is sufficiently porous to permit sound absorption at the higher frequencies.

It is also possible employing the instant invention to provide a structure which may be used independent of any preexisting wall. Two alternatives are possible. First, the bottom member of the cavity may be used to form one side of a partition and the panels may be used to form the other side of the partition as shown in FIG. 1. An alternative arrangement involves the formation of a structure similar to that shown in FIG. 10 where the panels (2) are again placed in close proximity so as to provide narrow slots (3) between them. The resonance cavity (29) is formed from a U or hat-shaped elongated box of similar height and width to the bottom member and support strips of the previously described structures. However, in this structure the support strip (30) is unitary with the bottom member of the cavity (31). In such cases the fibrous material (32) may be added to the bottom or to the sides (30) of the cavity as shown.

Figure 11:
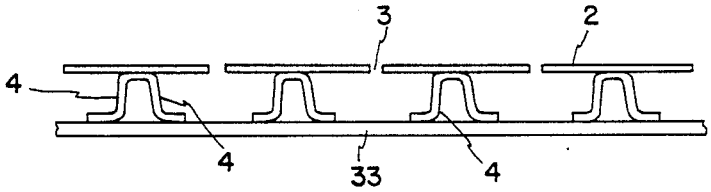
FIG. 11 shows another embodiment of the instant invention in which the support strips are individual to each panel and the room wall forms the bottom of the resonance cavities.

FIG. 11 demonstrates an alternative method for installing the structure of the instant invention. Like the other structures described herein, the panels (2) are attached to hat-shaped support strips (4) which form elongated channels for attachment to the room wall (33). In this structure the room wall itself provides the bottom member for the acoustical cavity and each hat-shaped channel provides two of the support strips for adjacent acoustical cavities. As with the other structures it is preferred that end caps (not shown) be provided to enclose both the top and the bottom of the cavities.

Figure 12:
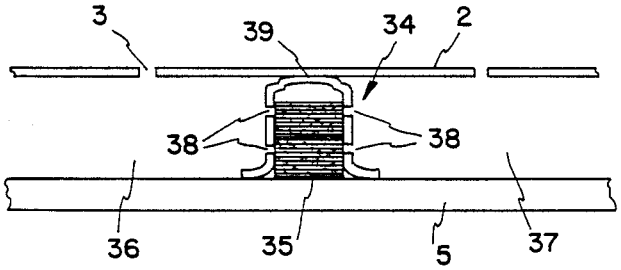
FIG. 12 is a cross section of one of the modified support strips of the instant invention.

In a modification of the hat-shaped channels of FIG. 11, the FIG. 12 structure includes a channel (34) which is provided with a fibrous acoustical material (35). The channel is also perforated at (38) to permit absorption of higher frequency sound. The fibrous material in the core of the channel (34) is of sufficient central density to avoid acoustical coupling between the adjacent cavities (36) and (37). Another feature of FIG. 12 permits the panel (2) to have the minimum amount of contact between it and the channel (34). This is accomplished by providing a raised longitudinal ridge (37) on the channel, in order to minimize the width of the contact area between the channel and the panel, allowing the panel to vibrate more freely and thus absorb more sound through vibration of the panel itself.

What is claimed:

1. A sound absorbing structure comprising a plurality of adjacent, elongated, substantially solid panels each attached to a support strip for supporting the panels in lengthwise and parallel but separate relationship wherein the distance between adjacent panel edges of adjacent panels defines a slot which is between about 1/16 and about ¾ inch and wherein said support strips are attached to a substantially solid bottom member such that the adjacent panels together with the support strips and the bottom member form first acoustical resonator cavities in communication with the slots which provide substantial sound absorption at a frequency of less than about 1000 Hz, and second closed cavities between adjacent first cavities for reducing acoustical coupling between adjacent first cavities.

2. The sound absorbing structure of claim 1, further comprising sound absorbing material partially filling the first acoustical resonator cavities.

3. The structure of claims 1 or 2 wherein more than two panels are provided.

4. The structure of claims 1 or 2 wherein the width of the slots is varied so as to provide acoustical resonance at a plurality of resonance frequencies.

5. The structure of claim 1 wherein the ratio of the length of the panels to the width of the panels is in the range of about 3:1 to about 18:1.

6. The structure of claims 1 or 2 wherein the support strip is in the form of a channel.

7. The structure of claims 1 or 2 wherein the support strip is hat-shaped in cross section.

8. The structure of claim 6 wherein the support strip is perforated and contains a fibrous sound absorbing material in the channel.

9. The structure of claims 1 or 2 wherein more than two sizes of resonator cavities are formed with each cavity having a different cross-sectional area so as to provide a range of sound absorption frequencies.

10. The structure of claim 9 wherein the cross-sectional area of the cavity is altered by the insertion of added bottom step members to alter the volume of the cavity.

11. The structure of claims 1 or 2 wherein the bottom member is provided by the wall, floor or ceiling to which the structure is attached.

12. The structure of claims 1 or 2 wherein the support strips are fibrous in nature.

13. The structure of claims 1 or 2 wherein the support strips and the bottom member for each cavity are formed from a unitary structure which is hat or U-shaped.

14. The structue of claims 1 or 2 wherein the support strips are hat or U-shaped and include a raised longitudinal ridge for contact between the panels and the support strips.

15. The structure of claim 1 wherein end closures are provided to enclose the cavities.

16. A sound absorbing structure comprising:

a plurality of adjacent, substantially solid panels in generally side-by-side, spaced apart relationship wherein the space between adjacent edges of adjacent panels defines a slot having a width of about 1/16 to $\frac{3}{4}$ inch;

a substantially solid bottom member spaced from the plurality of solid panels;

support means located in the space between the panels and the solid bottom member, interconnecting the panels to the solid bottom member, the support means being located between adjacent slots defined by adjacent panels, the support means cooperating with the panels to define first acoustical resonator cavities in air flow communication with the slots, said first acoustical resonator cavities having widths substantially greater than said slots and the support means cooperating with the bottom member to define closed second cavities between adjacent first cavities for reducing acoustical coupling between adjacent first cavities.

17. The sound absorbing structure of claim 16 further comprising sound absorbing material disposed in the first cavities.

18. The sound absorbing structure of claim 16 further comprising sound absorbing material disposed in the second cavities to provide further reduced acoustical coupling between adjacent first cavities.

* * * * *